US008672722B2

(12) United States Patent
Hirose et al.

(10) Patent No.: US 8,672,722 B2
(45) Date of Patent: Mar. 18, 2014

(54) SPARK PLUG MANUFACTURING METHOD

(75) Inventors: Kazumichi Hirose, Aichi (JP); Hirokazu Kurono, Nagoya (JP); Toshitaka Honda, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/002,128

(22) PCT Filed: Jan. 12, 2012

(86) PCT No.: PCT/JP2012/000145
§ 371 (c)(1),
(2), (4) Date: Aug. 29, 2013

(87) PCT Pub. No.: WO2012/120757
PCT Pub. Date: Sep. 13, 2012

(65) Prior Publication Data

US 2013/0337717 A1 Dec. 19, 2013

(30) Foreign Application Priority Data

Mar. 4, 2011 (JP) ..... 2011-047261

(51) Int. Cl.
*H01T 21/02* (2006.01)

(52) U.S. Cl.
USPC ..... 445/7; 445/3; 313/118; 313/143

(58) Field of Classification Search
USPC ..... 445/3, 7; 313/118, 143
See application file for complete search history.

(56) References Cited

U.S. PATENT DOCUMENTS

| | | | | |
|---|---|---|---|---|
| 5,254,954 | A | 10/1993 | Fujimoto et al. | 324/551 |
| 6,858,975 | B1 * | 2/2005 | Matsutani | 313/143 |
| 8,013,617 | B2 * | 9/2011 | Honda et al. | 324/551 |
| 2004/0051537 | A1 | 3/2004 | Hori | 324/557 |
| 2007/0228915 | A1 * | 10/2007 | Honda et al. | 313/143 |
| 2009/0224767 | A1 * | 9/2009 | Honda et al. | 324/400 |

FOREIGN PATENT DOCUMENTS

| | | | |
|---|---|---|---|
| DE | 10 2007 024 407 A1 | 11/2008 | G01R 31/18 |
| JP | 39-20383 | 9/1964 | |
| JP | 2550790 | 8/1996 | H01T 21/02 |
| JP | 2004-108817 | 4/2004 | G01R 31/12 |
| JP | 2009-238667 | 10/2009 | H01T 13/14 |

OTHER PUBLICATIONS

International Search Report for International Application No. PCT/JP2012/000145, Mar. 19, 2012.

* cited by examiner

*Primary Examiner* — Mary Ellen Bowman
(74) *Attorney, Agent, or Firm* — Kusner & Jaffe

(57) ABSTRACT

A spark plug manufacturing method providing a spark plug equipped with an insulator having dielectric strength by means of judging whether or not the insulator has a defect. A defect judgement step judges whether or not the insulator has a defect, by generating an electric potential difference between the center electrode and the metallic shell under conditions such that an assembly of the center electrode, metallic shell, and insulator is disposed within a pressure vessel; a high-pressure atmosphere higher in pressure than the atmospheric pressure is established within the pressure vessel; a space allowing the presence of insulating oil is a space surrounded by the packing, the metallic shell, the insulator, and an imaginary plane containing a forward end surface of the metallic shell; and the insulating oil is present at least in a region of the space where the distance between the ledge and insulator becomes shortest.

5 Claims, 4 Drawing Sheets

SPARK PLUG MANUFACTURING METHOD

FIELD OF THE INVENTION

The present invention relates to a method of manufacturing a spark plug for providing ignition in an internal combustion engine, and more particularly to a method of manufacturing a spark plug equipped with an insulator having dielectric strength.

BACKGROUND OF THE INVENTION

A spark plug for providing ignition in an internal combustion engine, such as an automobile engine, generally includes a tubular metallic shell; a tubular insulator disposed in the bore of the metallic shell; a center electrode disposed in a forward end portion of the axial bore of the insulator; a metal terminal disposed in a rear portion of the axial bore; and a ground electrode whose one end is joined to the forward end of the metallic shell and whose other end faces the center electrode, thereby forming a spark discharge gap therebetween. When high voltage is applied between the center electrode and the metallic shell, spark discharge is generated between the center electrode and the ground electrode and ignites fuel contained in a combustion chamber.

At the time of spark discharge, if the insulator has a defect, such as a fine pore, current may leak, through the defect, between the center electrode and the metallic shell (hereinafter, the current leakage may be referred to as penetrating discharge), potentially resulting in a failure to perform normal spark discharge.

In order to provide a method of readily and reliably detecting a defect in a ceramic insulator, Japanese Patent No. 2550790 ("Patent Document 1") describes "a defect detection method for a ceramic insulator, characterized in that: while the ceramic insulator having a hollow portion whose one end is open is held, spark discharge is generated between a first electrode inserted into the hollow portion of the ceramic insulator and a second electrode provided in the vicinity of ceramic insulator; a check is made to see whether spark discharge generated through generation of a voltage difference between the first and second electrodes has passed through the opening of the hollow portion of the ceramic insulator; and whether or not the ceramic insulator is acceptable is judged from whether or not the spark discharge has passed through the opening of the hollow portion" (claim 5 of Patent Document 1). According to this method, in the case where spark discharge is generated between the first and second electrodes while passing through the opening of the hollow portion of the ceramic insulator, the ceramic insulator is judged free of defect. In the case where spark discharge is generated between the first and second electrodes without passage through the opening of the hollow portion of the ceramic insulator, the ceramic insulator is judged defective, since penetrating discharge has been generated through passage through a defect in the ceramic insulator.

Meanwhile, in the above-mentioned defect detection method, in order to detect a finer defect in the ceramic insulator, it is effective to apply a higher voltage; i.e., a greater electric potential difference, between the first and second electrodes. This is for the following reason: in the case where the ceramic insulator has a defect, penetrating discharge is more likely to be generated through the defect. Thus, when the above-mentioned defect detection method is employed, increasing the electric potential difference between the first and second electrodes is conceived. However, even though applied voltage is increased, when applied voltage reaches a predetermined value, spark discharge is generated through the opening of the hollow portion. Therefore, application of voltage equal to or higher than the predetermined voltage is meaningless; i.e., there is a limit to mere application of high voltage for improvement of accuracy in detecting a fine defect in the ceramic insulator.

In order to cope with such a problem, Japanese Patent Application Laid-Open (kokai) No. 2004-108817 ("Patent Document 2") describes "a defect detection method for a ceramic insulator, characterized in that: . . . while the interior of the pressure vessel is sealed with air having a pressure higher than the atmospheric pressure, an electric potential difference is generated between the first electrode and the second electrode to thereby detect a leak current which flows between the first electrode and the second electrode, and whether or not the ceramic insulator has a defect is judged from whether or not the leak current is greater than a predetermined value" (claim 1 of Patent Document 2). According to the conception of this invention, by means of the interior of the pressure vessel being sealed with air having a pressure higher than the atmospheric pressure, aerial spark discharge between the first electrode and the second electrode is restrained, whereby there can be increased an electric potential difference required to generate spark discharge which passes through the hollow portion. Thus, while the generation of spark discharge which passes through the hollow portion is restrained, the electric potential difference between the two electrodes can be increased. As a result, there is improved accuracy in detecting a fine defect in the ceramic insulator.

Problems to be Solved by the Invention

However, according to the conventional methods of detecting a defect in the insulator, a defect detection test is conducted on the insulator in a state before attachment of the insulator to the metallic shell, etc. Accordingly, even though no defect is detected in the insulator, in the case where a defect arises in the insulator for a certain reason in the subsequent course of execution of various steps until completion of the spark plug (such as steps of attachment of the center electrode, the metallic shell, the insulator, etc.), the defect which has arisen in the steps cannot be detected. Thus, it is considered desirable to judge whether or not the insulator has a defect with respect to an intermediate product appearing in a step as close as possible to the final step of yielding a completed spark plug.

However, when high voltage is applied to such an intermediate product of the spark plug in which at least the insulator, the center electrode, and the metallic shell are assembled together, with a side toward the ground electrode being taken as the forward side, there are generated regular spark discharge between the center electrode and the ground electrode and spark discharges induced by electrical leak (hereinafter, may be referred to as flashover) between the forward end of the center electrode and the forward end of the metallic shell, between the forward end of the center electrode and a packing, etc. If the flashover is generated before generation of penetrating discharge through a defect in the insulator, a defect in the insulator cannot be detected. Thus, according to a conceivable method, the intermediate product is disposed within a pressure vessel, and the inner pressure of the pressure vessel is increased above the atmospheric pressure to thereby restrain the generation of the flashover; however, in order to restrain the generation of the flashover upon application of a highest voltage which is potentially applied to the spark plug in use with an internal combustion engine, the atmosphere in the pressure vessel must have a considerably high pressure.

Accordingly, increasing the size of a pressurizing apparatus and complication of apparatus management are unavoidable.

An object of the present invention is to provide a spark plug manufacturing method capable of providing a spark plug equipped with an insulator having dielectric strength, by means of judging whether or not the insulator has a defect.

SUMMARY OF THE INVENTION

Means for Solving the Problems

Means for solving the aforementioned problem is (1) a spark plug manufacturing method for manufacturing a spark plug comprising an insulator having an axial bore extending in a direction of an axis; a center electrode inserted into the axial bore; a metallic shell disposed externally of an outer circumference of the insulator and having a ledge projecting into interior thereof; a ground electrode joined to a forward end portion of the metallic shell and forming a gap in cooperation with the center electrode; and a packing disposed between the insulator and a surface of the ledge located on a rear side thereof opposite a forward side of the metallic shell where the gap is formed; the method being characterized by comprising a defect judgment step of judging whether or not the insulator has a defect, by means of generation of an electric potential difference between the center electrode and the metallic shell under conditions such that an assembly of the center electrode, the metallic shell, and the insulator is disposed within a pressure vessel, a high-pressure atmosphere higher in pressure than the atmospheric pressure is established within the pressure vessel, a space which allows the presence of insulating oil is a space surrounded by the packing, the metallic shell, the insulator, and an imaginary plane containing a forward end surface of the metallic shell, and the insulating oil is present at least in a region of the space where a distance between the ledge and the insulator becomes shortest.

Preferred modes of the method mentioned above in (1) are as follows: (2) the space which allows the presence of insulating oil is a second space surrounded by the packing, the metallic shell, the insulator, and an imaginary plane being orthogonal to the axis and containing a forward end of the ledge; (3) the insulating oil has a relative dielectric constant of 5 or less; (4) the atmosphere within the pressure vessel has a pressure of less than 5 MPa; and (5) the defect judgment step is performed before a step of forming the gap by bending the ground electrode.

Effects of the Invention

According to the spark plug manufacturing method of the present invention, the defect judgment step is performed by use of an assembly of at least the center electrode, the metallic shell, and the insulator. Therefore, the method can detect not only a defect which arises in the insulator in the course of manufacture of the insulator, but also a defect which may arise in the insulator for various causes in manufacturing steps, such as attaching steps. Also, the assembly is placed within the pressure vessel in which a high-pressure atmosphere higher in pressure than the atmospheric pressure is maintained, and whether or not a defect is present in the insulator is judged by means of generation of an electric potential difference between the center electrode and the metallic shell in a state of presence of insulating oil in the space. Therefore, creeping discharge can be restrained, which is a flashover, from the center electrode toward the packing along the surface of the insulator. As a result, in spite of application of voltage equivalent to required withstand voltage for use in an internal combustion engine, creeping discharge is not generated, and, if the insulator has a defect, penetrating discharge through the defect can be generated. Therefore, whether or not the insulator has a defect can be reliably judged by use of a simple apparatus. Thus, the manufacturing method of the present invention can provide a spark plug equipped with a defect-free insulator.

According to the spark plug manufacturing method of the present invention, since a space which allows the presence of the insulating oil is limited to a narrow space; namely, the second space, there can be prevented a false judgment that the defect-free insulator is judged defective, which could otherwise result from bubbles which are generated in the insulating oil when an electric potential difference is generated between the center electrode and the metallic shell.

According to the spark plug manufacturing method of the present invention, since the insulating oil has a relative dielectric constant of 5 or less, voltage to be applied to the insulator in the defect judgment step can be reduced, whereby load imposed on the insulator can be reduced.

According to the spark plug manufacturing method of the present invention, since the atmosphere within the pressure vessel has a pressure of less than 5 MPa, an increase in the size of a pressurizing apparatus and complication of apparatus management can be restrained.

According to the spark plug manufacturing method of the present invention, since the defect judgment step is performed before a step of forming the gap by bending the ground electrode, the generation of spark discharge between the center electrode and the ground electrode during the defect judgment step can be further restrained.

DETAILED DESCRIPTION OF THE INVENTION

Figure 1:
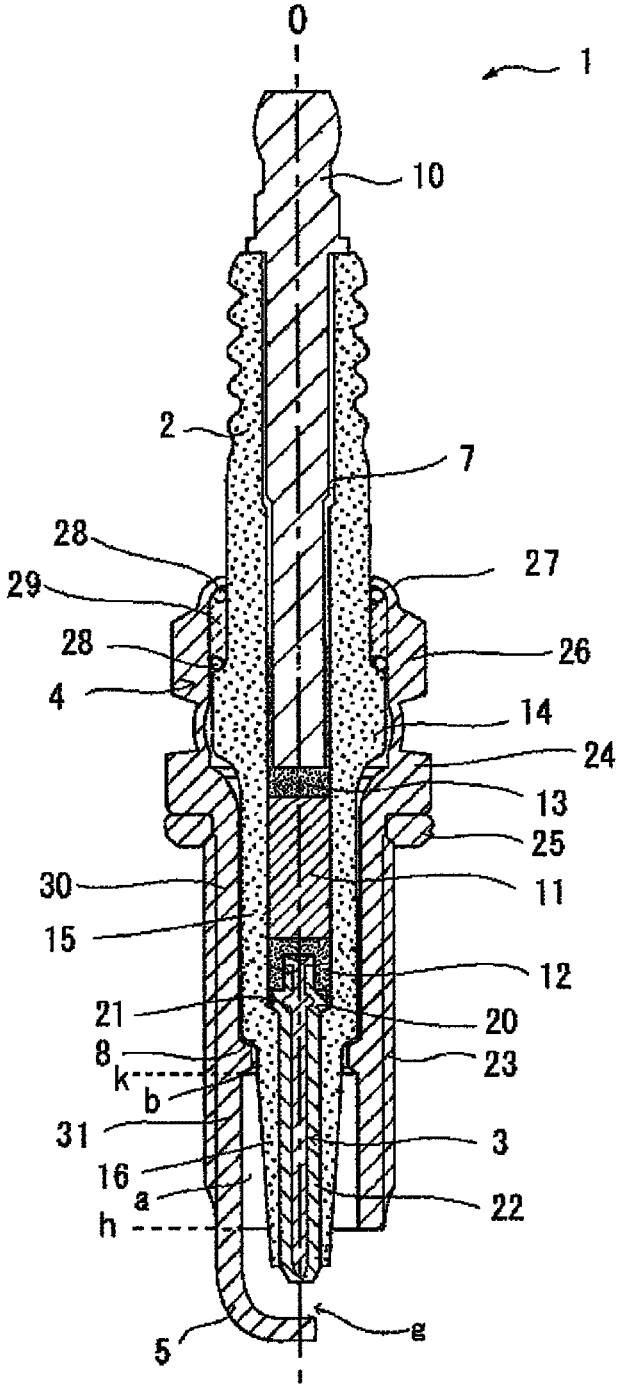
FIG. 1 is a sectional, overall explanatory view of a spark plug, showing an example spark plug to be manufactured by a spark plug manufacturing method of the present invention.
Figure 2:
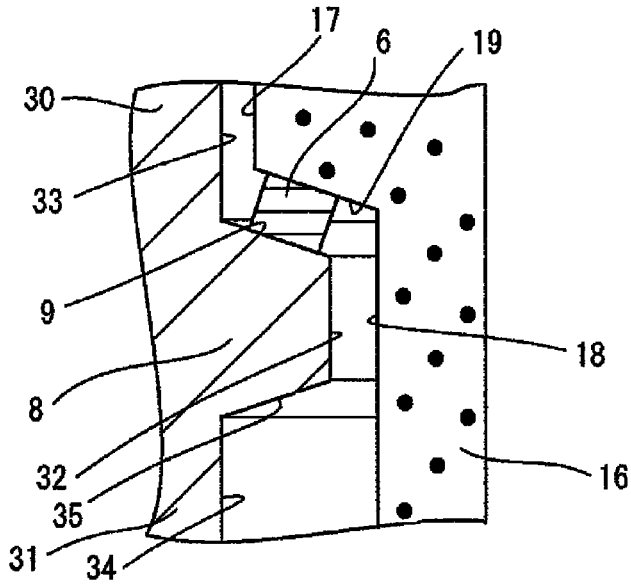
FIG. 2 is a sectional, explanatory view showing essential members of the spark plug shown in FIG. 1.

As shown in FIGS. 1 and 2, a spark plug 1 to be manufactured by the spark plug manufacturing method of the present invention includes an insulator 2 having an axial bore 7 extending in the direction of an axis O; a center electrode 3 inserted into the axial bore 7; a metallic shell 4 disposed externally of the outer circumference of the insulator 2 and having a ledge 8 projecting into the interior thereof; a ground electrode 5 joined to a forward end portion of the metallic shell 4 and forming a gap g in cooperation with the center electrode 3; and a packing 6 disposed, with a side of the metallic shell 4 toward the gap g being taken as the forward side of the metallic shell 4, between the insulator 2 and a first surface 9 of the ledge 8 located on a side toward the rear end of the ledge 8.

The insulator 2 is formed from a material having mechanical strength, thermal strength, electrical strength, etc.; for example, a ceramic sintered body which predominantly contains alumina, and has the axial bore 7 having a substantially cylindrical shape and extending in the direction of the axis O. The center electrode 3 in the form of a substantially circular column is held in a one end portion of the axial bore 7, and a metal terminal 10 in the form of a substantially circular column is held in the other end portion of the axial bore 7. A resistor 11 is provided as needed in the axial bore 7 between the center electrode 3 and the metal terminal 10 for the purpose of restraining the generation of radio noise, and electrically conductive glass seal layers 12 and 13 are provided on respective opposite sides of the resistor 11, thereby electrically connecting the center electrode 3 and the metal terminal 10 to each other. The insulator 2 has a flange portion 14 projecting radially outward and formed at a substantially central portion thereof with respect to the direction of the axis O; an intermediate trunk portion 15 located forward of the flange portion 14 and having a diameter smaller than that of the flange portion 14; and a leg portion 16 located forward of the intermediate trunk portion 15, having a diameter smaller than that of the intermediate trunk portion 15, and extending such that the diameter gradually reduces forward. An outer circumferential surface 17 of the intermediate trunk portion 15 and an outer circumferential surface 18 of the leg portion 16 is connected by a tapered step surface 19, and the packing 6 is disposed between the step portion 19 and the first surface 9 of the ledge 8 of the metallic shell 4 (which will be described later), the first surface 9 being located on the rear side of the ledge 8, whereby the insulator 2 is held by the metallic shell 4.

The center electrode 3 is formed from a material having thermal conductivity, mechanical strength, etc.; for example, an Ni-based alloy, such as INCONEL (trade name) 600. The center electrode 3 has a head portion 21 supported by a tapered step 20 which is formed in the axial bore 7 of the insulator 2 and connects the inner circumferential surface of the intermediate trunk portion 15 and the inner circumferential surface of the leg portion 16 smaller in inside diameter than the intermediate trunk portion 15, and a trunk portion 22 extending forward from the head portion 21 and having an outside diameter smaller than that of the head portion 21, and the center electrode 3 is held in and electrically insulated from the metallic shell 4 in a state in which a forward end of the trunk portion 22 projects from the forward end surface of the insulator 2.

The metallic shell 4 is formed from an electrically conductive steel material, such as low-carbon steel; has a substantially cylindrical shape; and accommodates and holds the insulator 2. The metallic shell 4 has a threaded portion 23 formed on the outer circumferential surface of its forward portion, and, by use of the threaded portion 23, the spark plug is mounted to an unillustrated cylinder head of an internal combustion engine. The metallic shell 4 has a flange-like gas seal portion 24 located rearward of the threaded portion 23, and a gasket 25 sandwiched between the gas seal portion 24 and the threaded portion 23. The metallic shell 4 has a tool engagement portion 26 located rearward of the gas seal portion 24 and allows a tool, such as a spanner or a wrench, to be engaged therewith, and a crimp portion 27 located rearward of the tool engagement portion 26. Ring packings 28 and talc 29 are disposed in an annular space formed between the outer circumferential surface of the insulator 2 and the inner circumferential surfaces of the crimp portion 27 and the tool engagement portion 26, whereby the insulator 2 is fixed to the metallic shell 4. The metallic shell 4 has an intermediate tube portion 30 located forward of the gas seal portion 24 and surrounding the intermediate trunk portion 15 of the insulator 2; the ledge 8 located forward of the intermediate tube portion 30 and projecting radially inward; and a forward tube portion 31 located forward of the ledge 8 and surrounding the leg portion 16 of the insulator 2. The ledge 8 has a cylindrical ledge inner circumferential surface 32 which projects most radially inward and is shortest in distance to the inner circumferential surface 18 of the leg portion 16 of the insulator 2; the tapered first surface 9 (a surface of the ledge 8 located on the side toward the rear end of the ledge 8) which connects the rear end of the ledge inner circumferential surface 32 and an intermediate-trunk-portion inner circumferential surface 33 greater in inside diameter than the ledge inner circumferential surface 32; and a tapered second surface 35 which connects the forward end of the ledge inner circumferential surface 32 and a forward-tube-portion inner circumferential surface 34 greater in inside diameter than the ledge inner circumferential surface 32.

The ground electrode 5 is formed into, for example, a substantially rectangular columnar body, and the shape and structure of the ground electrode 5 are designed as follows: one end of the ground electrode 5 is joined to the forward end surface of the metallic shell 4, and the body of the ground electrode 5 is bent at an intermediate position so as to assume a shape resembling the letter L and such that a distal end portion of the ground electrode 5 faces a forward end portion of the center electrode 3 via the gap g. The ground electrode 5 is formed from a material similar to that used to form the center electrode 3.

Next, the spark plug manufacturing method of the present invention is described. First described is a defect judgment step for the insulator, which is an important step in achieving the object of the present invention.

The defect judgment step in the spark plug manufacturing method of the present invention judges whether or not the insulator 2 has a defect, by means of generation of an electric potential difference between the center electrode 3 and the metallic shell 4 under conditions such that an assembly of the center electrode 3, the metallic shell 4, and the insulator 2 is disposed within a pressure vessel, a high-pressure atmosphere higher in pressure than the atmospheric pressure is established within the pressure vessel, a space which allows the presence of insulating oil is a first space a surrounded by the packing 6, the metallic shell 4, the insulator 2, and an imaginary plane h containing the forward end surface of the metallic shell 4, and the insulating oil is present at least in a region of the first space a where the distance between the ledge 8 and the insulator 2 becomes shortest.

By virtue of employment of the above-mentioned defect judgment step, upon application of a highest voltage which is potentially applied to the spark plug in use with an internal combustion engine, the spark plug manufacturing method of the present invention can reliably judge whether or not the insulator 2 has a defect which generates penetrating discharge. The highest voltage which is potentially applied is the sum of voltage to be applied to the spark plug in use with the internal combustion engine and voltage which may be accidentally applied to the spark plug (hereinafter, the sum of voltages may be referred to as required withstand voltage). The insulator 2 which does not generate penetrating discharge upon application of the required withstand voltage can be considered to have dielectric strength. By virtue of employment of the above-mentioned defect judgment step, the spark plug manufacturing method of the present invention can provide a spark plug equipped with the insulator 2 free from a defect which potentially causes the generation of penetrating discharge upon application of the required withstand voltage; i.e., a spark plug equipped with the insulator 2 having dielectric strength.

In the above-mentioned defect judgment step, instead of placing the mere insulator 2 within the pressure vessel, an assembly of at least the center electrode 3, the metallic shell 4, and the insulator 2 is disposed within the pressure vessel. What is disposed within the pressure vessel may be an intermediate product which is to become a completed spark plug after the defect judgment step, or an intermediate product which is to be yielded as a result of the assembly undergoing each of the steps to be described later. When the defect judgment step is performed on the mere insulator 2, even though no defect is detected in the insulator 2, in the case where a defect arises in the insulator 2 for a certain reason in the subsequent course of execution of various steps until completion of the spark plug (such as steps of attachment of the center electrode 3, the metallic shell 4, the insulator 2, etc.), the defect which has arisen in the steps cannot be detected, Thus, by means of the defect judgment step being performed on an intermediate product which is yielded at least after a step of yielding the above-mentioned assembly, desirably, on an intermediate product as close as possible to a completed product, a defect which has arisen in the steps can be reliably detected. However, an intermediate product yielded after a step of forming the gap g by bending the ground electrode 5 is apt to generate regular spark discharge across the gap g during the defect judgment step, potentially resulting in difficulty in detecting penetrating discharge of the insulator 2. Therefore, preferably, the defect judgment step is performed before a step of bending the ground electrode 5. The following description discusses the defect judgment step which is performed on the assembly of the center electrode 3, the metal terminal 10, the metallic shell 4, and the insulator 2, the assembly being disposed within the pressure vessel.

The above-mentioned defect judgment step detects whether or not penetrating discharge arises in the insulator 2 upon application of a required withstand voltage to the insulator 2, thereby judging whether or not the insulator 2 has a defect. The generation of penetrating discharge can be detected, for example, from the waveform of applied current. Withstand voltage required in recent years is higher than conventionally required one; for example, the insulator is required to have dielectric strength at 40 kV. Under the atmospheric pressure, when a high voltage of 40 kV is applied to the assembly, rather than to the mere insulator 2, before generation of penetrating discharge which passes through a defect in the insulator 2, flashover is generated between the forward end of the center electrode 3 and the forward end of the metallic shell 4, etc., resulting in a failure to judge whether or not the insulator 2 has a defect. Thus, through establishment of a high-pressure atmosphere higher in pressure than the atmospheric pressure in the pressure vessel, the generation of spark discharge in the air can be restrained to a certain extent. However, in order to restrain the generation of flashover before generation of penetrating discharge at the time of application of a voltage of 40 kV, the pressure of the atmosphere within the pressure vessel must be 7 MPa or higher as will be described later. In order to establish such a high-pressure environment, a large-sized pressurizing apparatus must be prepared; furthermore, apparatus management becomes complicated.

Meanwhile, when high voltage is applied to the assembly, flashover may possibly be generated between the forward end of the center electrode 3 and the forward end of the metallic shell 4, between the rear end of the metal terminal 10 and the crimp portion 27 of the metallic shell 4, and between the packing 6 and the forward end of the center electrode 3. Among these flashovers, the flashover between the packing 6 and the forward end of the center electrode 3 is more likely to be generated than the other flashovers to be generated through the air, since the flashover is creeping discharge generated from the forward end of the center electrode 3 toward the packing 6 along the surface of the insulator 2.

In the above-mentioned defect judgment step, an electric potential difference is generated between the center electrode 3 and the metallic shell 4 under conditions such that a high-pressure atmosphere is maintained within the pressure vessel such that spark discharge is unlikely to be generated, insulating oil can be present in the first space a, and the insulating oil is present at least in a region of the first space a where the distance between the ledge 8 and the insulator 2 becomes shortest. Therefore, the generation of creeping discharge along the surface of the insulator 2 can be restrained. By virtue of presence of insulating oil in the first space a, the generation of the flashover which is most likely to be generated can be restrained. Therefore, without need to increase the pressure of an atmosphere within the pressure vessel to 7 MPa, through application of voltage equivalent to required withstand voltage, whether or not the insulator 2 has a defect can be reliably judged. The pressure of an atmosphere within the pressure vessel is higher than the atmospheric pressure, preferably higher than 1.5 MPa, and, in view of restraint of an increase in size of a pressurizing apparatus and complication of apparatus management, the pressure is preferably less than 5 MPa. Notably, the pressure is absolute pressure.

The insulating oil is a liquid having a volume resistivity at 80° C. of $1.0\times10^8$ (Ω·cm) or more, and examples of such an insulating oil include electrical insulating oils described in JIS C 2320, such as mineral oil, alkylbenzene, polybutene, alkylnaphthalene, alkyldiphenylalkane, and silicone oil.

The insulating oil may be present at least in a region where the distance between the ledge 8 and the insulator 2 becomes shortest, and the insulating oil can be present in the first space a. As mentioned above, creeping discharge along the surface of the insulator 2 is most likely to be generated, and, when an insulating oil having high volume resistivity is present in the first space where the creeping discharge is to be generated, current becomes unlikely to flow, whereby the generation of creeping discharge can be restrained. When the insulating oil is present at least in a region where the distance between the ledge 8 and the insulator 2 becomes shortest, there can be restrained the generation of flashover stemming from generation of dielectric breakdown in the region.

Preferably, the space which allows the presence of the insulating oil is a second space b surrounded by the packing 6, the metallic shell 4, the insulator 2, and an imaginary plane k which is orthogonal to the axis and contains the forward end of the ledge 8. By means of limitation, to a minimum necessary amount, of the amount of the insulating oil which can be present in a space surrounded by the insulator 2 and the metallic shell 4, the insulator 2 free from a defect is prevented from being mistakenly judged defective. For example, when an electric potential difference is generated between the center electrode 3 and the metallic shell 4, in a state in which the first space a is filled with the insulating oil, bubbles may be generated in the insulating oil. As a result of the bubbles causing a change in the waveform of current, the defect-free insulator 2 may be mistakenly judged defective. Therefore, by means of the second space b allowing the presence of the insulating oil, a false judgment can be prevented. Notably, the forward end of the ledge 8 is the boundary between the second surface 35 and the forward-tube-portion inner circumferential surface 34, and is a forward proximal end of the radially projecting ledge 8.

Preferably, the relative dielectric constant of the insulating oil is 5 or less. At a relative dielectric constant of the insulating oil of 5 or less, voltage applied to the insulator 2 can be reduced, whereby there can be restrained load which the defect judgment step imposes on the insulator 2.

Preferably, the insulating oil has such a boiling point as to vanish through vaporization after the defect judgment step. If the insulating oil vanishes through vaporization after the defect judgment step, transfer to the next step can be made quickly without need to do particular processing.

Figure 3:
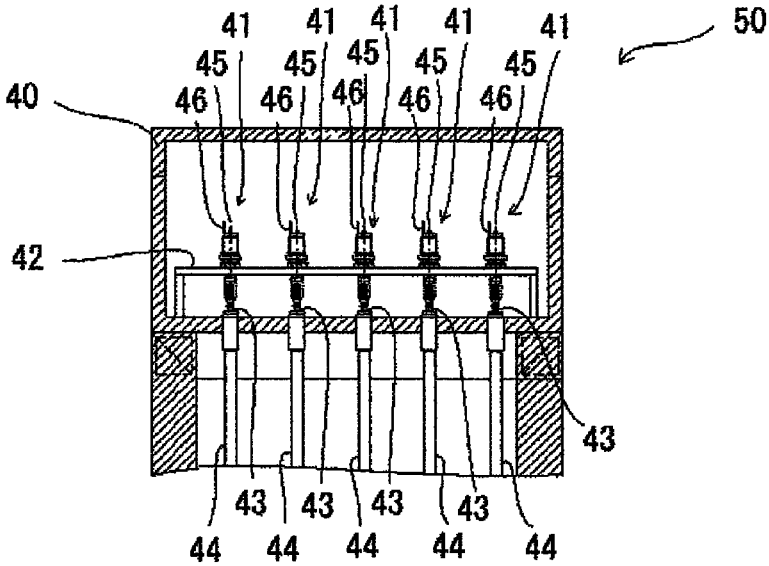
FIG. 3 is a sectional, explanatory view showing an example pressure vessel.

As shown in FIG. 3, the pressure vessel 50 includes, for example, a vessel 40 having pressure resistance, and a fixing plate 42 of metal provided within the vessel 40 and adapted to dispose assemblies 41 thereon. The fixing plate 42 has, for example, a plurality of circular holes, and the assemblies 41 are disposed in the respective holes such that the ground electrodes 46 face upward. A compressor is connected to the pressure vessel 50 through piping (not shown). The metal terminals 43 of the assemblies 41 are electrically connected to a power supply (not shown) via connection cables 44. The power supply is configured to be able to measure current which flows between the fixing plate 42 and the metal terminals 43 connected to the connection cables 44. In the case where the assemblies 41 do not have the metal terminals 43 attached thereto, metal rods are connected to end portions of the connection cables 44 on a side opposite connections to the power supply, and the rods and the corresponding center electrodes 45 are electrically connected together.

In the defect judgment step, first, the assemblies 41 are disposed within the pressure vessel 50. After the assemblies 41 are disposed within the pressure vessel 50, the insulating oil is charged into the first spaces a or the second spaces b which encompass respective regions where the distance between the ledge and the insulator becomes shortest. Next, the interior of the pressure vessel 50 is maintained at a predetermined pressure by means of the compressor, and the power supply applies a predetermined voltage to the assemblies 41 via the connection cables 44 for a predetermined time. At this time, currents which flow between the metal terminals 43 and the fixing plate 42 are measured, and whether or not the insulators 2 have a defect is judged from the waveforms of the currents.

Next will be described an example spark plug manufacturing process which excludes the defect judgment step. First, the center electrode 3 and the ground electrode 5 can be manufactured as follows: for example, by use of a vacuum melting furnace, molten alloys having desired compositions are prepared; ingots are prepared from the molten alloys through vacuum casting; subsequently, the ingots are subjected to plastic working for imparting predetermined shapes and predetermined dimensions thereto, thereby yielding the center electrode 3 and the ground electrode 5. The center electrode 3 can also be formed as follows: an inner material is inserted into a cup-like outer material, and the resultant assembly is subjected to plastic working, such as extrusion, thereby yielding the center electrode 3.

Next, one end portion of the ground electrode 5 is joined, by electric resistance welding or laser welding or the like, to the forward end surface of the metallic shell 4 formed into a predetermined shape by plastic working, etc.

Next, if necessary, a molten material obtained by melting a tip material having a predetermined composition is formed into a sheet material; predetermined tips are punched out from the sheet material by hot punching, thereby forming noble metal tips; the noble metal tips are fixedly fused to the center electrode 3 and the ground electrode 5, respectively, by resistance welding and/or laser welding or the like.

Meanwhile, the insulator 2 is manufactured by firing ceramic or the like into a predetermined shape; the center electrode 3 having a noble metal tip joined thereto is inserted into the axial bore 7 of the insulator 2; and a glass powder for forming the glass seal layer 12, a resistor composition for forming the resistor 11, and the glass powder are charged, in this order, into the axial bore 7 while being preliminarily compressed. Next, while the metal terminal 10 is pressed into the axial bore 7 from an end portion of the axial bore 7, the resistor composition and the glass powders are compressed and heated. Thus, the resistor composition and the glass powders are sintered, thereby forming the resistor 11 and the glass seal layers 12 and 13. Next, the packing 6 is disposed on the ledge 8 of the metallic shell 4 having the ground electrode 5 joined thereto, and the insulator 2 having the center electrode 3, etc., fixed thereto is attached to the thus-prepared metallic shell 4, thereby forming an assembly. The assembly undergoes the aforementioned defect judgment step.

Finally, a distal end portion of the ground electrode 5 is bent toward the center electrode 3 such that the gap g is formed between one end of the ground electrode 5 and a forward end portion of the center electrode 3, thereby yielding a spark plug.

The defect judgment step is performed after formation of the assembly of at least the center electrode 3, the metallic shell 4, and the insulator 2. In the above-mentioned manufacturing process, the insulator 2 to which the center electrode 3, the resistor 11, and the metal terminal 10 are attached is attached to the metallic shell 4; however, no particular limitation is imposed on the order of attachment of these members; for example, after the insulator 2 is attached to the metallic shell 4, the center electrode 3 may be attached to the resultant assembly. In this case, the defect judgment step may be performed before the resistor 11 and the metal terminal 10 are attached to the insulator 2. In the above-mentioned manufacturing process, the insulator 2 is attached to the metallic shell 4 to which the ground electrode 5 is joined; however, after all components are attached to the metallic shell 4, the ground electrode 5 may be joined to the resultant metallic shell 4.

The spark plug manufactured by the spark plug manufacturing method according to the present invention is used as an ignition plug for an automobile internal combustion engine, such as a gasoline engine, and is fixed at a predetermined position by threadingly engaging the threaded portion 23 with a threaded hole provided in a head (not shown) which dividingly forms combustion chambers of the internal combustion engine.

The spark plug manufacturing method according to the present invention is not limited to the above-described embodiment, but may be modified in various other forms, so long as the object of the present invention can be achieved.

EXAMPLES

<Manufacture of Assemblies> Assemblies of the center electrode, the resistor, the metal terminal, the insulator, the metallic shell, and the ground electrode were manufactured according to the above-mentioned manufacturing process. Since each of the assemblies is such that the ground electrode is not bent, the gap g is not formed. Also, the thread size was M12, and the intermediate trunk portions of the insulators had a thickness of 3 mm.

Example 1

Figure 4:
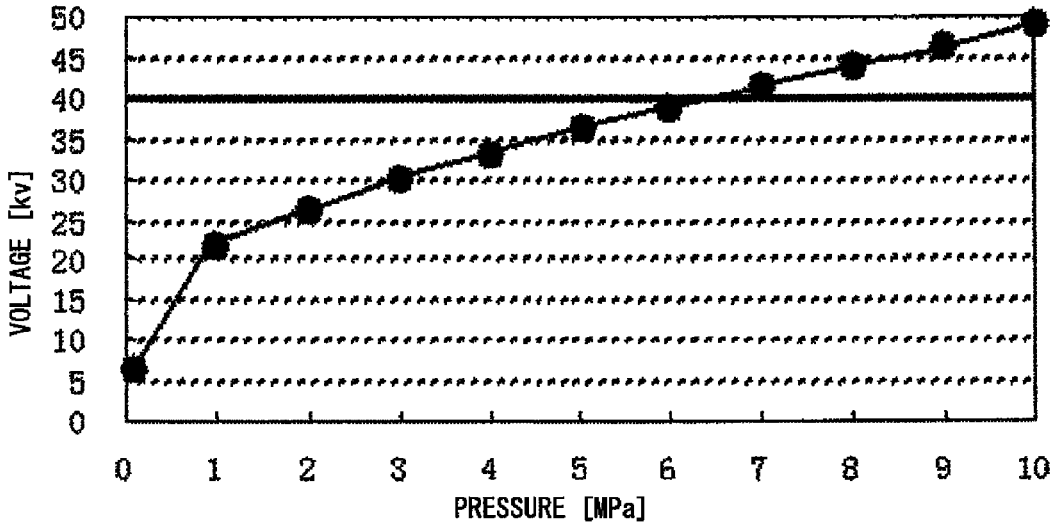
FIG. 4 is a diagram showing the relationship between the pressure of an atmosphere within the pressure vessel and voltage at which flashover is generated.

<Evaluation Method> The assemblies were disposed within the pressure vessel shown in FIG. 3 such that the ground electrodes faced upward; while the atmosphere within the pressure vessel was maintained at predetermined pressures ranging from the atmospheric pressure to 10 MPa, voltage was applied to the metal terminals, thereby generating electric potential differences between the center electrodes and the metallic shells. Under this condition, while voltage was being gradually increased, currents flowing between the metal terminals and the fixing plate were measured, and voltages at the time of generation of flashovers were measured from the waveforms of the measured currents. The test was conducted three times for each of the pressures, and the average of the measured voltages was calculated. FIG. 4 shows the results of the test.

Example 2

Figure 5:
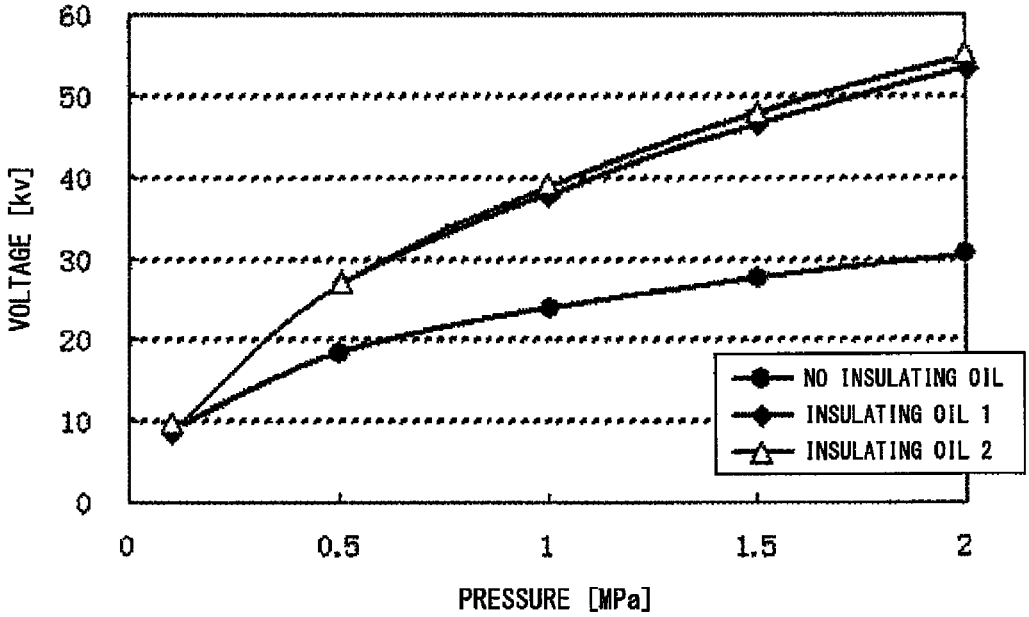
FIG. 5 is a diagram showing the relationship between the pressure of an atmosphere within the pressure vessel and voltage at which flashover is generated, showing the distinction between the presence and absence of an insulating oil.

The test was conducted in a manner similar to that of Example 1 except that the atmosphere within the pressure vessel was maintained at predetermined pressures ranging from the atmospheric pressure to 2 MPa and that the insulating oil is charged into the first space a surrounded by the packing, the metallic shell, the insulator, and an imaginary plane which contains the forward end surface of the metallic shell. FIG. 5 shows the results of the test. Insulating oil 1 had a relative dielectric constant of 2.0 and a volume resistivity at 80° C. of $1.0\times10^{15}$ Ω·cm, and insulating oil 2 had a relative dielectric constant of 1.5 and a volume resistivity at 80° C. of $2.0\times10^{13}$ Ω·cm.

Example 3

Figure 6:
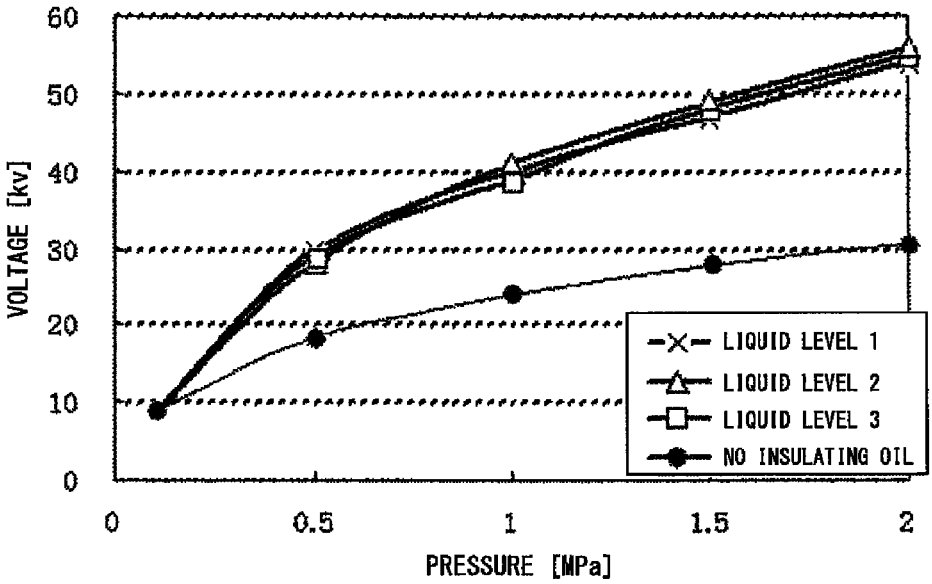
FIG. 6 is a diagram showing the relationship between the pressure of an atmosphere within the pressure vessel and voltage at which flashover is generated, showing the distinction among the amounts of charge of an insulating oil.

The test was conducted in a manner similar to that of Example 2 except that the insulating oil 1 was used while being varied in amount. FIG. 6 shows the results of the test. In FIG. 6, liquid level 1 indicates the case where the insulating oil is charged up to a liquid level which contains the center of the ledge inner circumferential surface with respect to the direction of the axis O; liquid level 2 indicates the case where the insulating oil is charged up to a liquid level which contains the forward end of the ledge; and liquid level 3 indicates the case where the insulating oil is charged up to a liquid level which contains the center of the axial length between the forward end of the ledge and the forward end of the metallic shell.

Example 4

Figure 7:
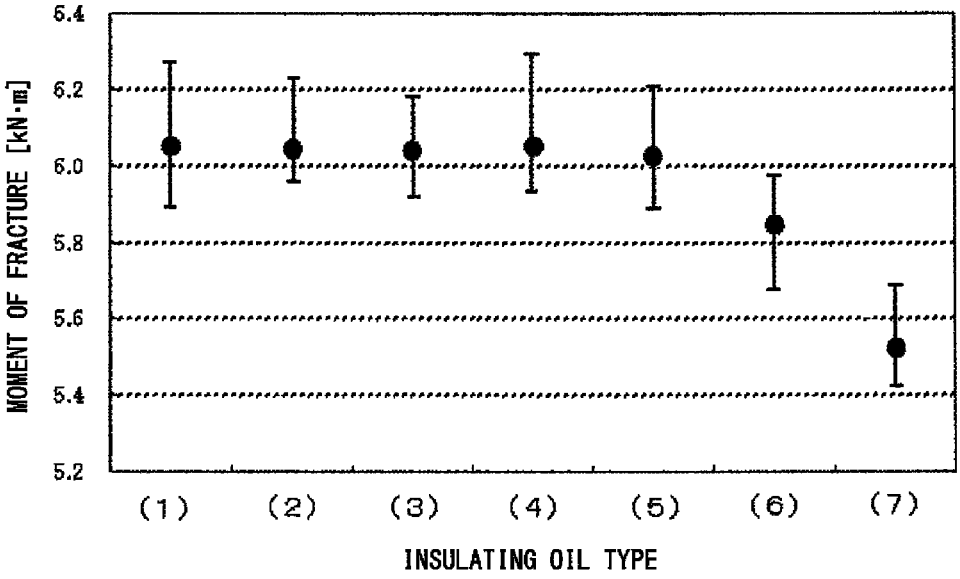
FIG. 7 is a diagram showing the effect of insulating oils having different relative dielectric constants on load which is imposed on an insulator.

Seven types of insulating oils having a volume resistivity at 80° C. of $1.0\times10^{13}$ and a relative dielectric constant of 1 to 7 were prepared and named insulating oils (1) to (7). The test was conducted in a manner similar to that of Example 2 except that: while these insulating oils were used, and the atmosphere within the pressure vessel was maintained at a pressure of 1.5 MPa, a voltage of 40 kV was applied for 10 minutes. Next, the assemblies were taken out from the pressure vessel, and pressure (p) was applied to the forward ends of the insulators until the insulators fractured. The distance (d) from a point of application of pressure to a fracture surface was measured; the moment of fracture (m) was calculated according to the expression given below; and, on the basis of the moment of fracture, the insulators were evaluated for strength. Moment of fracture (m)=pressure (p)×distance (d). The test was conducted three times for each of the insulating oils (1) to (7). FIG. 7 shows the results of the test. The strengths of the insulators were evaluated under the following criteria, and Table 1 shows the results of the evaluation. AAA: lower limit of the moment of fracture 5.8 or more; BBB: lower limit of the moment of fracture 5.6 to less than 5.8; and CCC: lower limit of the moment of fracture 5.4 to less than 5.6.

TABLE 1

| Insulating oil type | (1) | (2) | (3) | (4) | (5) | (6) | (7) |
|---|---|---|---|---|---|---|---|
| Relative dielectric constant | 1 | 2 | 3 | 4 | 5 | 6 | 7 |
| Evaluation | AAA | AAA | AAA | AAA | AAA | BBB | CCC |

As shown in FIG. 4, the higher the pressure of an atmosphere within the pressure vessel, the greater the extent of restraint on generation of flashover; i.e., the higher the voltage at which flashover is generated. Example 1 indicates that, in order to prevent the generation of flashover at a required withstand voltage of 40 kV, an atmosphere within the pressure vessel must have a pressure of at least 7 MPa.

As shown in FIG. 5, when the insulating oil is present in a space between the insulator and the metallic shell, the voltage increases at which flashover is generated. Also, the higher the pressure of an atmosphere within the pressure vessel, the higher the voltage at which flashover is generated. Example 2 indicates that, under the condition that the insulating oil is present, and the pressure is at least 1.5 MPa, flashover is not generated upon application of a required withstand voltage.

As shown in FIG. 6, a difference in the amount of charge of the insulating oil does not raise a big difference among voltages at which flashover is generated, and, if the insulating oil is charged up to at least the liquid level 1, the generation of flashover is restrained.

As shown in FIG. 7, in the case of use of the insulating oils having a relative dielectric constant of 5 or less, a big difference does not arise among the moments of fracture of the insulators, indicating that, even though high voltage is applied to the insulators, loads imposed on the insulators are restrained.

DESCRIPTION OF REFERENCE NUMERALS

1: spark plug
2: insulator
3, 45: center electrode
4: metallic shell
5, 46: ground electrode
6: packing
7: axial bore
8: ledge
9: first surface
10, 43: metal terminal
11: resistor
12, 13: glass seal layer
14: flange portion
15: intermediate trunk portion
16: leg portion
17: outer circumferential surface
18: outer circumferential surface

19: step surface
20: tapered step
21: head portion
22: trunk portion
23: threaded portion
24: gas seal portion
25: gasket
26: tool engagement portion
27: crimp portion
28: ring packing
29: talc
30: intermediate tube portion
31: forward tube portion
32: ledge inner circumferential surface
33: intermediate-trunk-portion inner circumferential surface
34: tube-portion inner circumferential surface
35: second surface
40: vessel
41: assembly
42: fixing plate
44: connection cable
50: pressure vessel

The invention claimed is:

1. A method of manufacturing a spark plug comprising an insulator having an axial bore extending in a direction of an axis; a center electrode inserted into the axial bore; a metallic shell disposed externally of an outer circumference of the insulator and having a ledge projecting into interior thereof; a ground electrode joined to a forward end portion of the metallic shell and forming a gap in cooperation with the center electrode; and a packing disposed between the insulator and a surface of the ledge located on a rear side thereof opposite a forward side of the metallic shell where the gap is formed, the method comprising:

a defect judgment step of judging whether or not the insulator has a defect, by means of generation of an electric potential difference between the center electrode and the metallic shell under conditions such that an assembly of the center electrode, the metallic shell, and the insulator is disposed within a pressure vessel, a high-pressure atmosphere higher in pressure than the atmospheric pressure is established within the pressure vessel, a space which allows the presence of insulating oil is a space surrounded by the packing, the metallic shell, the insulator, and an imaginary plane containing a forward end surface of the metallic shell, and the insulating oil is present at least in a region of the space where a distance between the ledge and the insulator becomes shortest.

2. A method of manufacturing a spark plug according to claim 1, wherein the space which allows the presence of insulating oil is a second space surrounded by the packing, the metallic shell, the insulator, and an imaginary plane being orthogonal to the axis and containing a forward end of the ledge.

3. A method of manufacturing a spark plug according to claim 1, wherein the insulating oil has a relative dielectric constant of 5 or less.

4. A method of manufacturing a spark plug according to claim 1, wherein the atmosphere within the pressure vessel has a pressure of less than 5 MPa.

5. A method of manufacturing a spark plug according to claim 1, wherein the defect judgment step is performed before a step of forming the gap by bending the ground electrode.

* * * * *